US006374454B1

(12) United States Patent
Vilarasau Alegre

(10) Patent No.: US 6,374,454 B1
(45) Date of Patent: Apr. 23, 2002

(54) DEVICE FOR CLEANING AIR CONDUITS

(76) Inventor: Maria Teresa Vilarasau Alegre, Puigllancada, 28, Urb. Les Pungoles, E-08459, Sant Antoni de Vilamajor (ES)

( * ) Notice: Subject to any disclaimer, the term of this patent is extended or adjusted under 35 U.S.C. 154(b) by 0 days.

(21) Appl. No.: 09/403,855

(22) PCT Filed: Jul. 6, 1998

(86) PCT No.: PCT/ES98/00194

§ 371 Date: Jan. 18, 2000

§ 102(e) Date: Jan. 18, 2000

(87) PCT Pub. No.: WO99/43449

PCT Pub. Date: Sep. 2, 1999

(30) Foreign Application Priority Data

Feb. 27, 1998 (ES) ..... 9800428

(51) Int. Cl.[7] ..... A47L 5/00
(52) U.S. Cl. ..... 15/395; 15/405; 15/406
(58) Field of Search ..... 15/304, 393, 395, 15/405, 406, 104.12

(56) References Cited

U.S. PATENT DOCUMENTS 354,204 A * 12/1886 McLaughlin ..... 15/406
4,718,142 A * 1/1988 Wahlers ..... 15/395
5,347,677 A * 9/1994 Prentice ..... 15/318
5,377,381 A * 1/1995 Wilson ..... 15/304
5,528,789 A * 6/1996 Rostamo ..... 15/395
5,745,948 A * 5/1998 Lloyd et al. ..... 15/104.12
6,026,538 A * 2/2000 Watanabe ..... 15/406
6,058,547 A * 5/2000 Foster ..... 15/104.12

FOREIGN PATENT DOCUMENTS

WO 92/05888 * 4/1992
WO 93/24246 * 12/1993

* cited by examiner

*Primary Examiner*—Robert J. Warden, Sr.
*Assistant Examiner*—Theresa T. Snider
(74) *Attorney, Agent, or Firm*—Maria Parrish Tungol; John A. Parrish

(57) ABSTRACT

Device to clean air ducts which, as it includes a header connected to a compressed air generator by means of a supply hose, is characterised because the header has a front part (5) which can be connected in an adjustable fashion, to a back part (4) provided with many compressed air outlets formed by flexible bands (6) which make random movements owing to the reaction forces originated by the compressed air outlet through them, and which lash the walls of the duct.

9 Claims, 6 Drawing Sheets

DEVICE FOR CLEANING AIR CONDUITS

OBJECT OF THE INVENTION

This invention refers to a device to clean air ducts, which consists of a header which is inserted In the duct to be cleaned, and which is connected by means of a supply hose, to a compressed air generator. The header is provided with a front part with an impact cushioning system, and a back part connected to the front and provided with compressed air outlets composed of flexible bands which move during the output of the compressed air, which significantly improves the effective cleaning of the inside surface of the duct, including recesses, corners and areas of difficult access.

BACKGROUND TO THE INVENTION

As a background to the invention, different devices with the same cleaning purpose as this invention, can be mentioned. The European Patent E90850157 includes generating a major vacuum inside the duct to be cleaned, using an air current produced to move a cleaning element, such as a brush, inside the duct.

Patent E91905065 includes the use of a cleaning device connected, by means of a supply hose, to a compressed air source. This device consists of an annular groove through which the compressed air used to clean the duct, is projected, and at the same time producing reaction forces which are used to move the device inside the duct.

Patent E9197477 also includes a cleaning element connected by means of a duct, to a compressed air source. The element has one or more openings in the shape of nozzles, directed backwards. The cleaning elements have an annular groove-shaped nozzle, through which compressed air is discharged to clean the walls of the duct.

Similarly to the previous two, Patent WO 9324246 consists of a duct which connects a compressed air source to a spherical body provided with outlets for the compressed air, directed towards the back, so that the duct is cleaned at the same time as the body advances.

These devices include, therefore, a cleaning element which is connected by a supply hose, to a compressed air source. This cleaning element has compressed air outlets, which simultaneously clean the duct and move the element forward.

These devices have different problems; when the cleaning element is operating, movements are abrupt and uncontrolled, owing to the reaction forces produced by the outlet of compressed air, causing the element to continuously knock against the walls of the duct being cleaned and leading to damage. Also, when these cleaning elements move forward in an uncontrolled fashion, it is possible that corners and recesses where compressed air is not sufficient, may not be cleaned properly. Finally, the diameter, the section or the upward downward or zigzag lay-out of the duct are features which, separately or together prevent these current methods of cleaning from being used, meaning that it is necessary to have several different types of methods or leave lengths of duct uncleaned.

DESCRIPTION OF THE INVENTION

The device of this Invention consists of a header which is inserted inside the duct to be cleaned, and connected by means of a supply hose to a compressed air generator. This header consists of two parts, a front part and a back part, which are held together by means of a thread. Many flexible bands are connected to the back part, through which all or part of the compressed air emerges.

The front part consists of a low density soft body and hard body, with a diameter greater than all the components of the header, in order to cushion possible knocks of the header against the walls of the duct, preventing damage both to these walls and to the header.

The thread which connects the front to the back part can be a screw type with nut, in which case, the soft body and the hard body are bore-holed, so that the screw passes through the hole to the rear part, which holds the socket of the nut. The screw and ring are loose parts, or they can be placed in the back of the front part and capped in a cavity coinciding with the front surface of the back part.

The coupling of the two main parts, up until now called the front and the back, is such that the distance between them can be adjusted, so that if they are completely joined, all the compressed air has to go out through the bands, but if a distance is left, adjusted on unscrewing the front part if it can be unscrewed, or through the planned manufacture of the hard body of the front part when both main parts are joined by screw and nut, the compressed air will also go out through this circular groove. The curtain of air formed when the compressed air goes out through the circular groove, means that the bands moving at random, will never be in front of the header as they will not be able to cross through the curtain, and in some types of cleaning, this is an extra advantage.

The compressed air enters the unit of the two parts through the back part, which has a tubular tab at the back to connect the hose connected to the compressed air generator. The inside hole of the tubular tab is prolonged to the front surface of this back part, and from there it is distributed to be ejected through the bands or through the groove left between the two main parts.

This back part also has many holes in the front, which extend to the back surface of the back part. Soft and flexible bands are attached to these holes, which are therefore directed towards the back of the header.

The reaction force caused by the discharge of compressed air through the bands, makes them move at random, which together with the fact that the length of these bands is adjusted to the diameter of the duct, causes them to lash on the layers of dirt deposited on the walls of the duct and to ensure deep cleansing of the duct, which up until now was impossible, as when the bands lash against the walls, they peel off the dirt which is compacted against the wall and which cannot be cleaned with a jet of compressed air alone. As the bands are flexible and soft, they do not cause damage to the duct when they lash against the walls.

Figure 1:
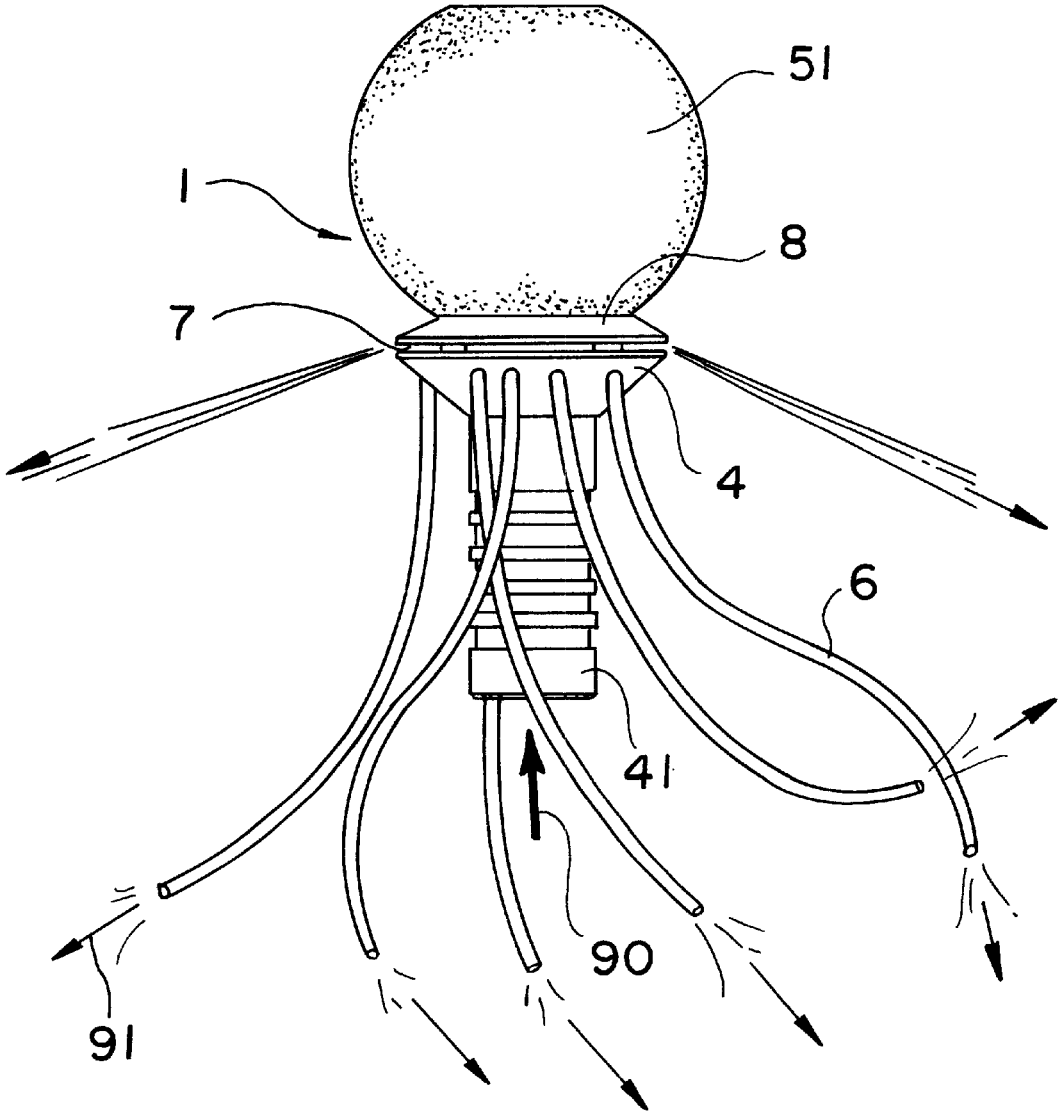
FIG. 1: Vertical section of a header with bands and open annular groove.
Figure 2:
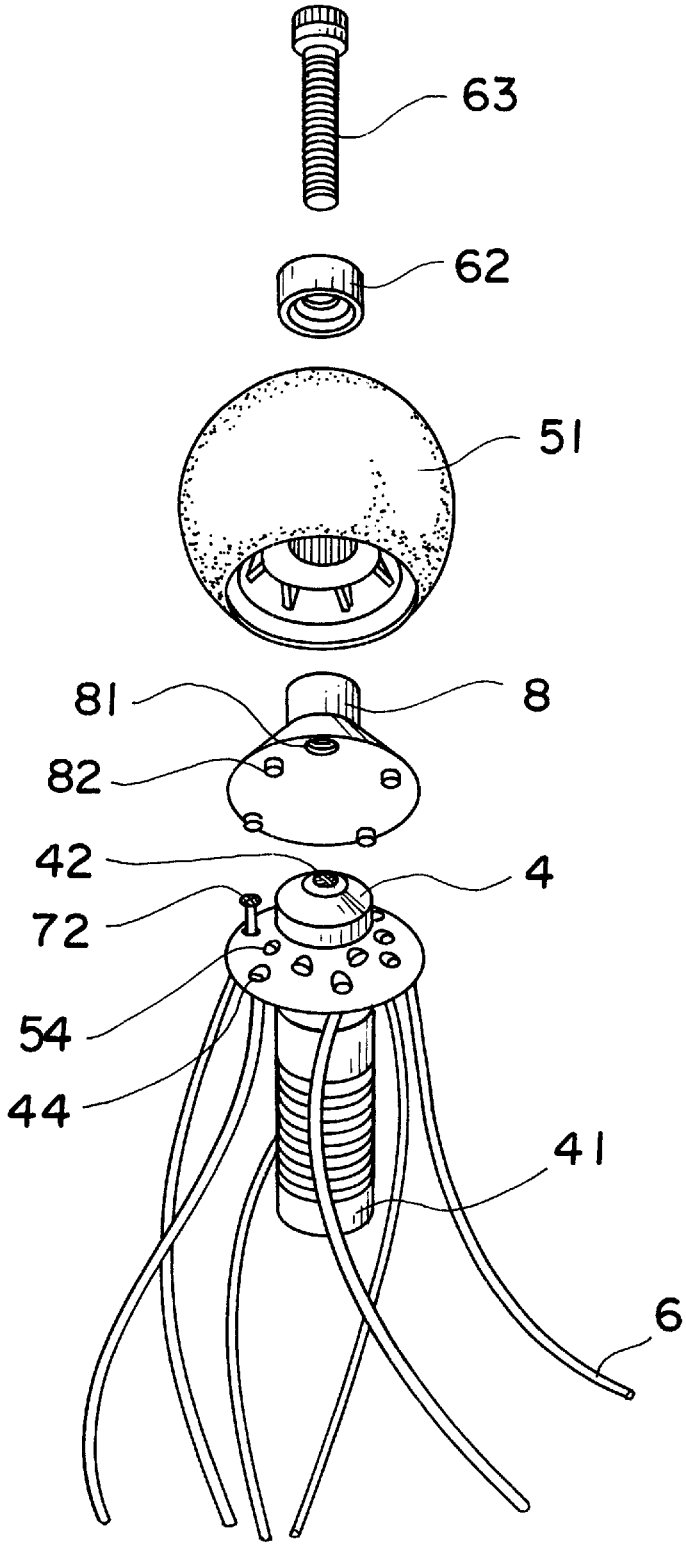
FIG. 2: Breakdown of parts of the header with bands, according to FIG. 1.
Figure 3:
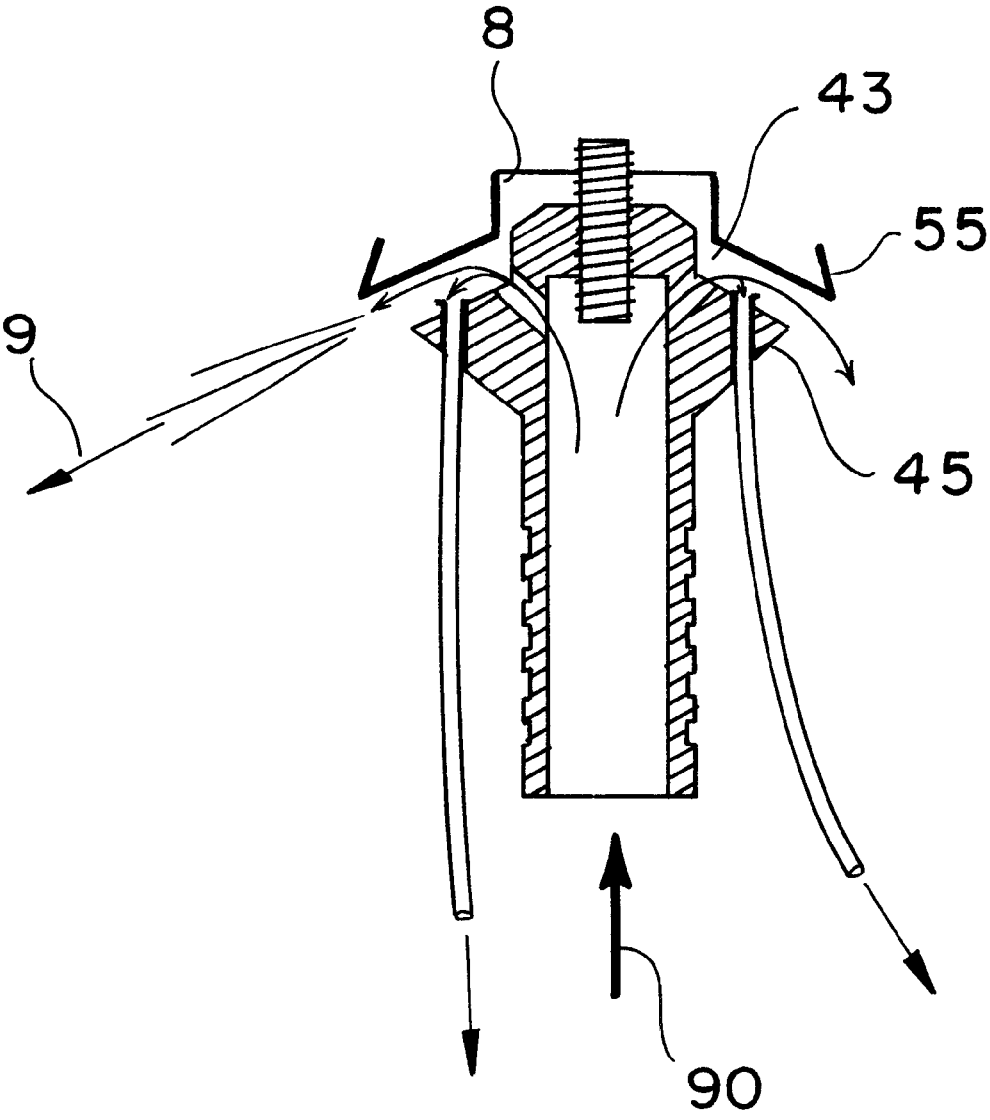
FIG. 3: Section of the back part of the header with bands according to FIG. 1.
Figure 4:
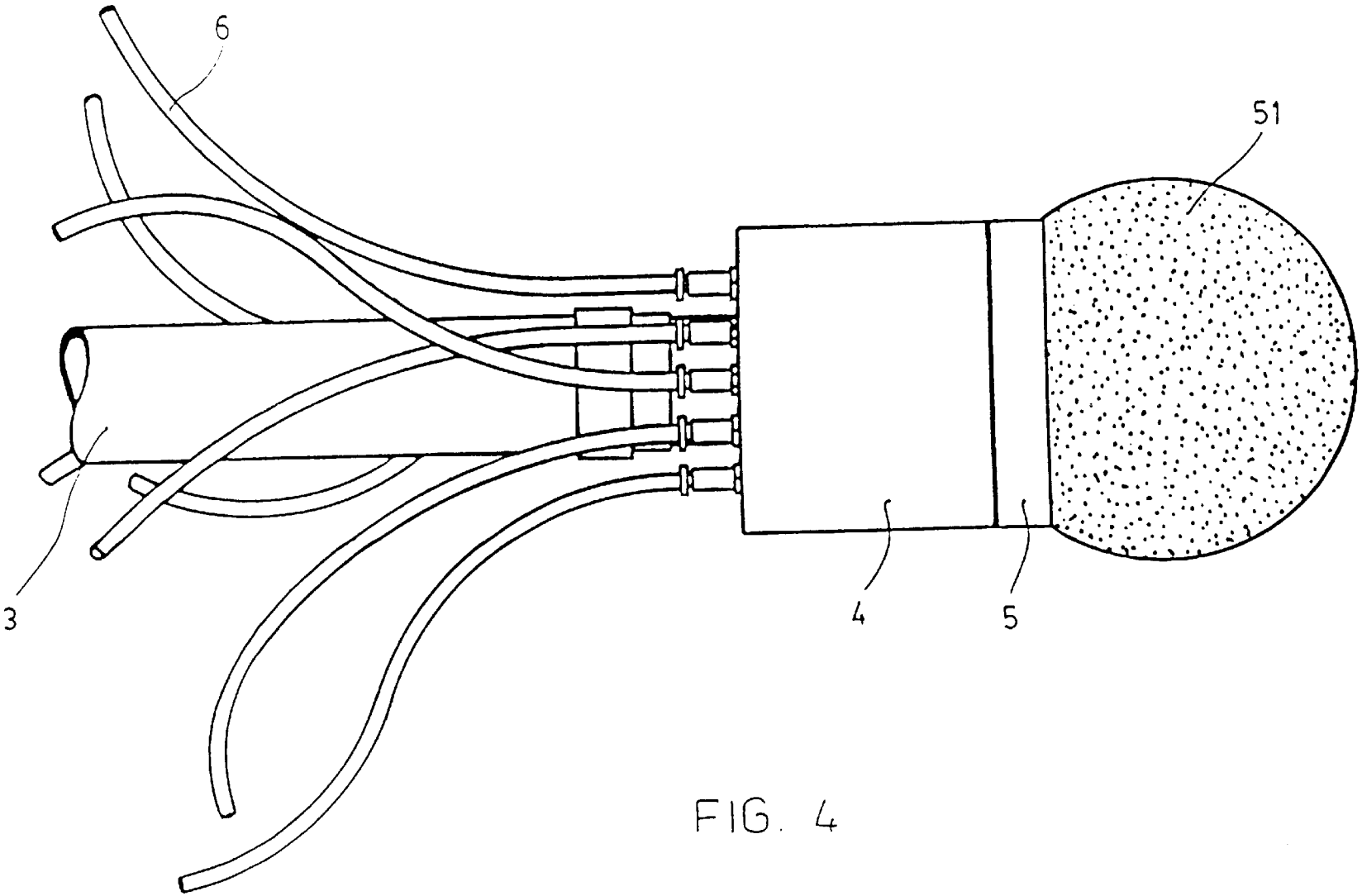
FIG. 4: Section of the two parts forming the other header with bands.
Figure 5:
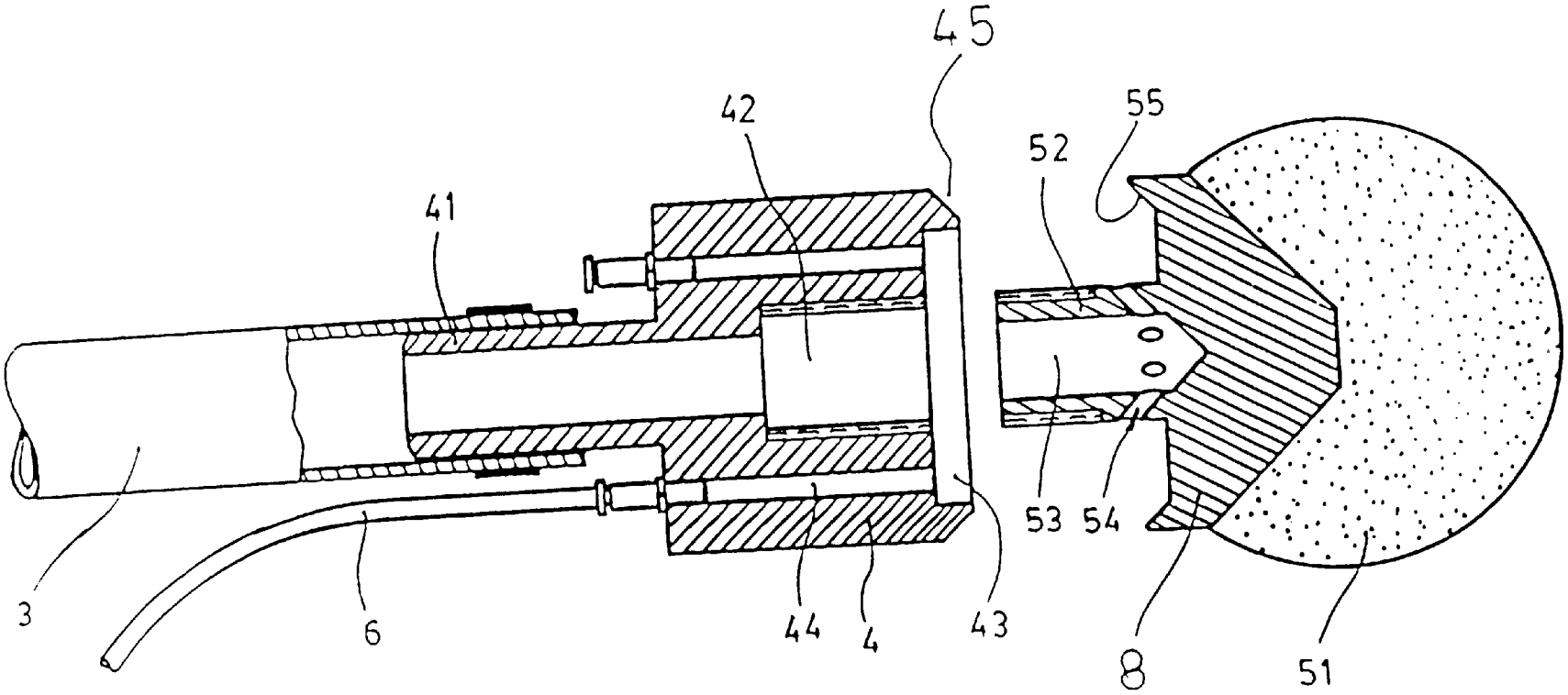
FIG. 5: Vertical section of the header according to FIG. 4 with closed annular groove.
Figure 6:
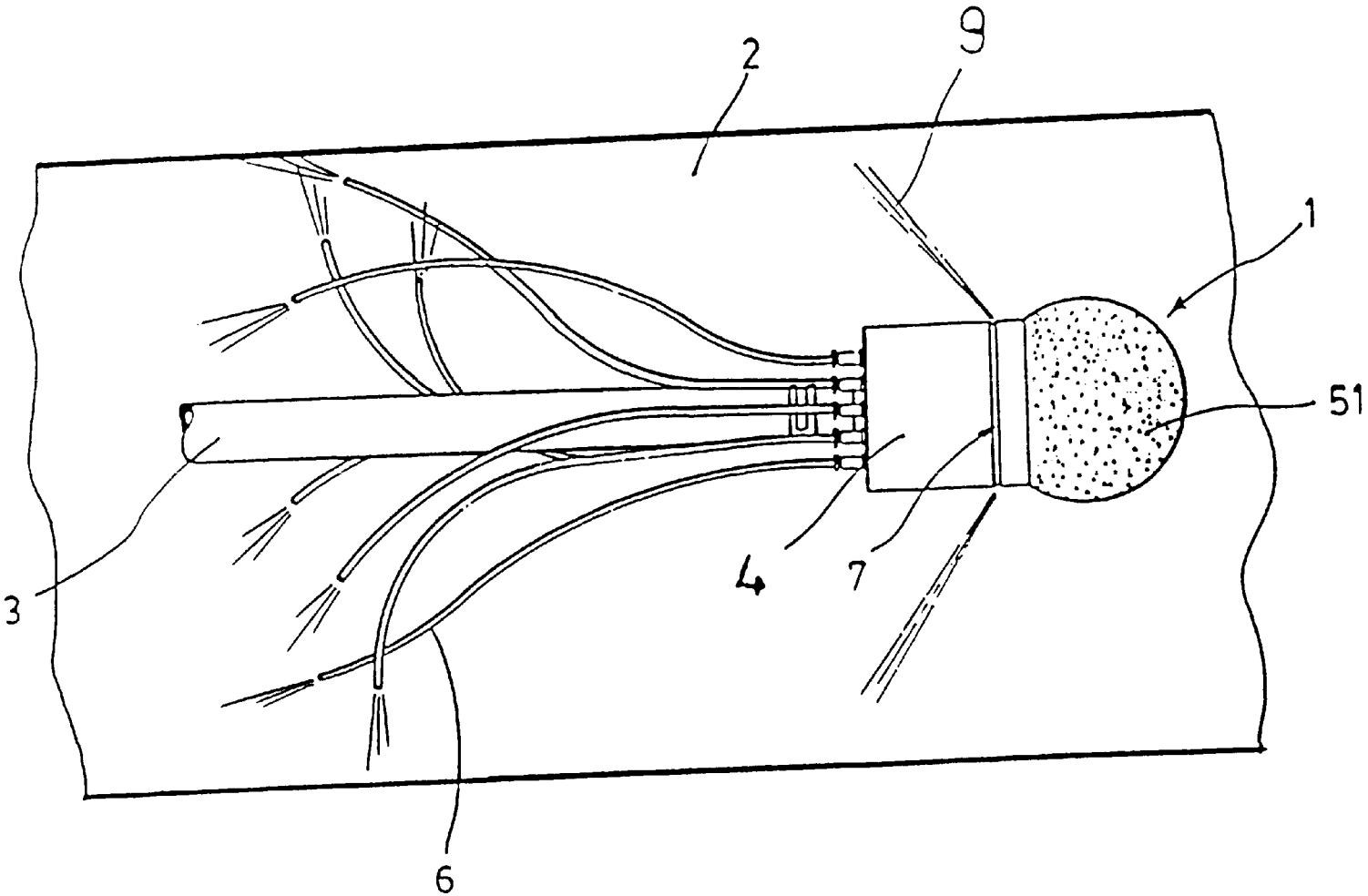
FIG. 6: Vertical section of the device which is the object of this invention while an air-conditioning duct is being cleaned, showing the annual outlet of the header in the open position and the duct to be cleaned vertically cross-sectioned.

Parts indicated:

1. Header.
2. Duct to be cleaned.
3. Compressed air hose.
4. Back part of header 1.
5. Front part of header 1.
6. Flexible band.
7. Annular groove between the front and back parts.
8. Hard body of the front part.
9. Air curtain formed by groove 7.
41. Tubular tab of the back part.
42. Base of nut to hold the front part to the back.
43. Compressed air distributor cavity inside header 1.
44. Outlets for compressed air.
45. Conical trunk surface of the back part 4.
51. Soft body of the front part.
52. Threaded tab of the hard body 8 if there is no screw 63.
53. Inside hole of tab 52 through which the compressed air passes.
54. Compressed air inlets to cavity 43.
55. Conical trunk surface of the hard body 8.
62. Screw ring.
63. Fastening screw of front part to the back.
72. Countersunk extension of band 6.
81. Opening through which the screw passes to join the front part to the back.
82. Teeth to fix the opening of the circular groove 7.
90. Compressed air inlet to the header.
91. Compressed air outlet through the bands.

Detailed Description of the Invention

As it can be observed in the above indicated drawings, the device consists of a header (1) connected to a compressed air generator by means of a hose (3). The header (1) consists of a back part (4) connected to the hose (3), a front part (5) fixed to part (4) and soft and flexible bands of any length (6) which are joined to part (4) and directed towards the back of the header. The bands (6) make random movements and lash against the dirt deposited on the inside wall of the duct.

The rear part (4) is connected to the hose (3) by means of a tubular tab (41) the inner hole of which is prolonged to holes (54), which lead to cavity (43), from where the compressed air will go out to the duct through the groove (7) and through the bands (6).

The front part 5 is connected to the back 4 by means of a screw (63), with ring (62) which is inserted in the base (42) or by a threaded part (42) which can be inserted in the base (42).

Part (4) also has holes (44) in the cavity (43). Bands (6) are connected to these holes (44) by flaring one of its ends, with the band passing through the hole, and letting the flared length (72) act as a self-adjusted stop precisely by the compressed air, or they are connected by a so-called quick connection pneumatic hose, which clamps the tube.

The purpose of the soft body (51) is to dampen possible knocks of the header (1) against the duct walls (2) during the cleaning operation.

The threaded tab (52) which is connected to the threaded portion (42) of part (4) has an inside cavity (53) where the compressed air goes after being introduced in the header through the hose (2). It also has holes (54) through which the compressed air passes to cavity (43), which distributes the compressed air outlet through the bands (6) and the groove (7).

If parts (4 and 5) are partially threaded, an annular groove (7) will be formed which is an additional outlet of compressed air.

The width of the annular groove (7) formed between the conical trunk surfaces (45 and 55) is adjusted by means of screwing the parts (4 and 5) to a greater or lesser extent, if there is a tab (52), or by changing the hard body (8) for another with teeth (82) of a different height.

Depending on the lay-out and features of the duct (2), the annular groove (7) is adjusted, because the variations in the proportion of compressed air through the bands (6) and the groove (7) causes considerably different displacement, swinging or lashing movements of the header and its bands. The curtain of air (9) will prevent the bands from entering the header.

What is claimed is:

1. Device to clean air ducts comprising a header (1) connected to a compressed air generator by a supply hose wherein the header has a front part (5) adjustably connected to a back part (4) to form annular groove (7) therebetween having a multitude of compressed air outlets, and a plurality of flexible bands (6) attached to the outlets for transmitting compressed air therethrough, whereby the compressed air causes the bands (6) to move to lash the walls of the ducts.

2. Device, according to claim 1 wherein the back part (4) has a tubular tab (41) for connection to a supply hose (3).

3. Device, according to claim 2 wherein the tubular tab has an inner hole that (41) is provided with a threaded portion (42) and a cavity (43) in order to distribute the compressed air through outlets (44) and (7).

4. Device, according to claim 3 wherein the bands (6) are connected to holes (44) formed in part (4).

5. Device according to claim 4 wherein the front part of the header (1) includes body (51) to dampen possible knocks of the header (1) against the walls of the duct (2) to be cleaned.

6. Device according to claim 1 wherein parts (4 and 5) form opposite conical trunk surfaces (45 and 55), between which a chamber (43) is formed.

7. Device, according to claim 6 wherein the back part (4) has outlets (54) to enable flow of compressed air towards chamber (43).

8. The device of claim 6 wherein parts (4 and 5) are spaced apart by teeth (82) to form annular groove (7).

9. The device of claim 6 wherein parts (4 and 5) are threadedly connected to enable adjustment of the width of annular groove (7).

* * * * *